US007673878B2

(12) United States Patent
Skoff et al.

(10) Patent No.: US 7,673,878 B2
(45) Date of Patent: Mar. 9, 2010

(54) METHOD AND APPARATUS FOR PLAYING A WAGERING GAME BASED UPON THE ARRIVAL OF AN ELEVATOR CAR

(76) Inventors: Roger E. Skoff, 10132 Northridge Dr., Alta Loma, CA (US) 91737; Michael D. Riley, 1807 Alabama St., Huntington Beach, CA (US) 92648

( * ) Notice: Subject to any disclaimer, the term of this patent is extended or adjusted under 35 U.S.C. 154(b) by 414 days.

(21) Appl. No.: 11/649,989

(22) Filed: Jan. 4, 2007

(65) Prior Publication Data

US 2008/0164654 A1 Jul. 10, 2008

(51) Int. Cl.
*A63B 71/00* (2006.01)

(52) U.S. Cl. ..... 273/138.1; 273/139

(58) Field of Classification Search ..... 273/138.1, 273/139

See application file for complete search history.

(56) References Cited

U.S. PATENT DOCUMENTS 4,322,612 A * 3/1982 Lange ..... 463/28
4,540,174 A * 9/1985 Coppock ..... 463/17
6,135,881 A * 10/2000 Abbott et al. ..... 463/3
6,287,199 B1 * 9/2001 McKeown et al. ..... 463/40
6,296,250 B1 * 10/2001 Langan ..... 273/139
6,394,895 B1 * 5/2002 Mino ..... 463/3
6,474,649 B1 * 11/2002 Kennedy et al. ..... 273/304
6,666,769 B2 * 12/2003 Stronach ..... 463/40
6,783,128 B2 * 8/2004 Casey et al. ..... 273/298
2006/0068888 A1 * 3/2006 Okada et al. ..... 463/20

OTHER PUBLICATIONS

"Proposition Bet", Sep. 13, 2006, Wikipedia—Definition of Proposition Bet, http://en.wikipedia.org/wiki/Proposition_bet.*
"Gambling on Gaming", Copyright 2006, CasinoMaze, http://www.casinomaze.com/gambling-on-gaming.html.*

* cited by examiner

*Primary Examiner*—Gene Kim
*Assistant Examiner*—Joseph B Baldori
(74) *Attorney, Agent, or Firm*—Timothy Thut Tyson; Ted Masters; Freilich, Hornbaker & Rosen

(57) ABSTRACT

A gaming method allows players to predict and place a wager about the future arrival of an elevator car at the floor of a building. If the player's prediction is correct, the player receives a payoff. The method can be played in buildings having one or more elevators. In an embodiment of the invention, a self-service automated gaming machine accommodates making the prediction, placing the wager, and receiving the payoff.

26 Claims, 8 Drawing Sheets

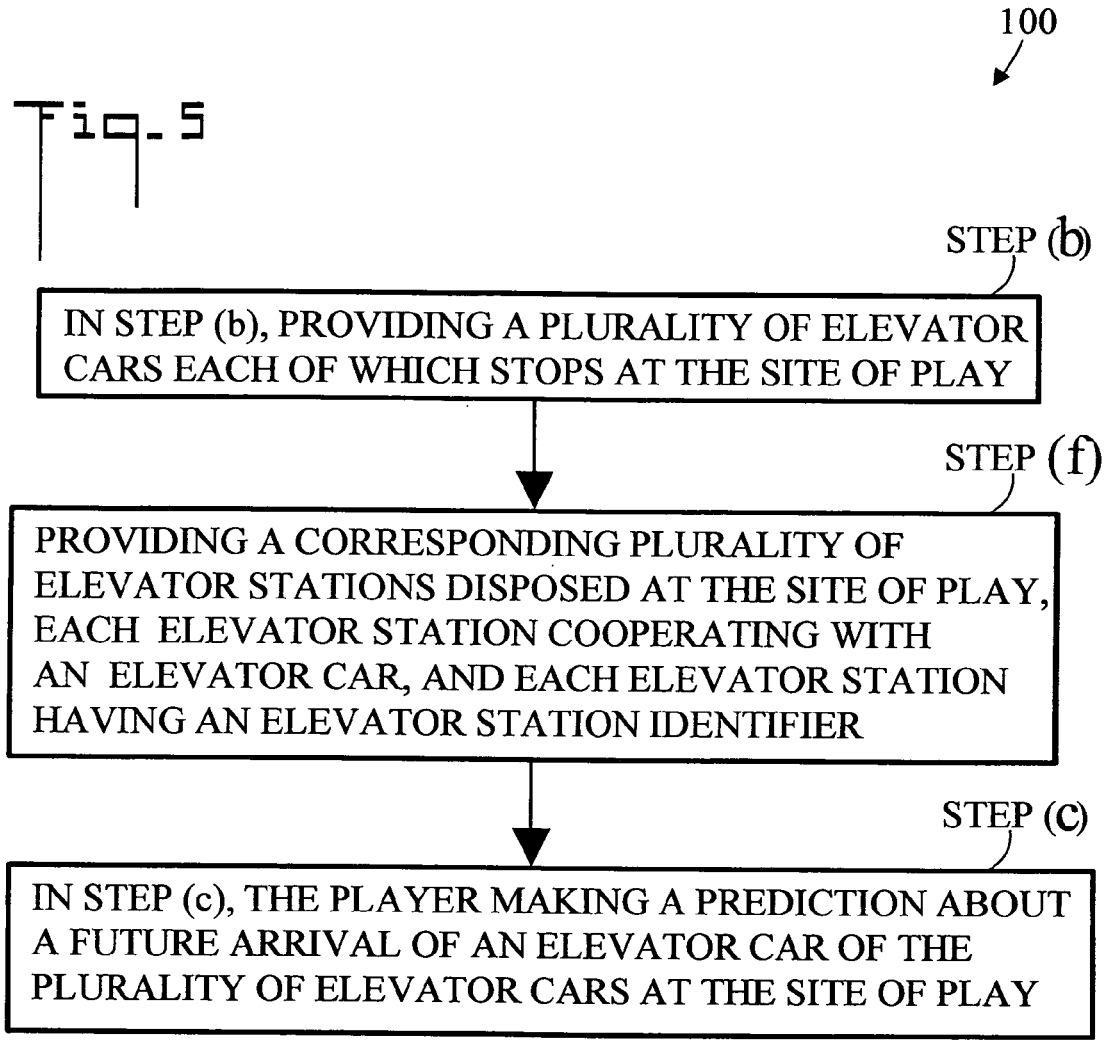
100
Fig. 5
STEP (b)
IN STEP (b), PROVIDING A PLURALITY OF ELEVATOR CARS EACH OF WHICH STOPS AT THE SITE OF PLAY
STEP (f)
PROVIDING A CORRESPONDING PLURALITY OF ELEVATOR STATIONS DISPOSED AT THE SITE OF PLAY, EACH ELEVATOR STATION COOPERATING WITH AN ELEVATOR CAR, AND EACH ELEVATOR STATION HAVING AN ELEVATOR STATION IDENTIFIER
STEP (c)
IN STEP (c), THE PLAYER MAKING A PREDICTION ABOUT A FUTURE ARRIVAL OF AN ELEVATOR CAR OF THE PLURALITY OF ELEVATOR CARS AT THE SITE OF PLAY

METHOD AND APPARATUS FOR PLAYING A WAGERING GAME BASED UPON THE ARRIVAL OF AN ELEVATOR CAR

TECHNICAL FIELD

The present invention pertains generally to wagering games, and more particularly to a wagering game and apparatus in which bets are made on the arrival of an elevator car at a particular floor of a multi-story building.

BACKGROUND OF THE INVENTION

Most multi-story buildings have elevators for transporting passengers to and from the various floors of the buildings. Any particular elevator car arrives at any given floor at substantially random times. This random arrival situation can serve as the basis of a wagering game.

BRIEF SUMMARY OF THE INVENTION

The present invention is directed to a wagering game in which a player or players wager upon the arrival of a particular elevator car at a floor (the "site of play") of a building. The game will typically be played by a person who is waiting for an elevator to arrive to take him or her to another floor. The game comprises a multiple option betting game which may be offered to the public in any of a variety of ways wherever at least one elevator is available and where placing wagers is a legal commercial practice (i.e., legally accepted, privately operated lottery games involving prizes, consideration, and chance).

The object of the game is for the bettor (the "player") to correctly predict information about the next elevator car to arrive at the floor (i.e. the next elevator door to open), and to be rewarded for correct predictions. To play, the player places his or her wager and selects one or more betting options.

For example the player may bet that a selected elevator:

WILL open next; or,

Will NOT open next.

If betting that an elevator will NOT open next, players may place as many bets as they wish, depending on the number of elevators in service at the floor.

Unless at the top or bottom floor, the player may bet that a selected elevator:

Will be going UP; or,

Will be going DOWN.

Additional betting options may include which elevator bank will have the next arriving elevator, the number of the next arriving elevator, whether or not there are people in the elevator, how many people are in the elevator, how many people will exit, whether there is an odd or even number of people in the elevator car, or any other people or elevator contents variable for which odds can be calculated and betting odds assigned. Other options could involve elevator timing (e.g. will any elevator or a particular elevator arrive at the betting location within a stated [fixed or player selected] time period?). Betting odds and payouts for time period betting would necessarily be variable to recognize the actual odds involved with the time period bet upon. Combination bets would also be possible on any combination of betting options.

True odds for any possible bet can be calculated for any location of play (building floor), and will be determined by the number of elevators in service in the bank and whether or not movement in both directions is possible from that location. Unless there is a lower level, no up or down betting will be possible from a ground floor location. Similarly, no up or down betting will be available from a top floor location. Betting odds can be assigned by the game operator (the "house") as the house sees fit and as its experience indicates to be most likely to maximize profits and patron satisfaction.

The game may be operated by a human being on site, by human beings at remote locations with on-site-machine support (for example, security monitoring, communication, and money handling devices), or by an automated gaming machine.

If operated by a human being (the "operator") on site, the operator would explain the game as necessary, take all bets, verify and record the outcome of each playing of the game (e.g. which elevator opened and which ones did not; whether the elevator that opened was going up or down, whether the house won or lost, and in what amount), keep and guard all house cash (the house "bank") and all house winnings, and make all payouts to winners. A second on site operator or remote monitoring of all betting transactions could provide protection to the house against operator error, embezzlement, or collusion with the player.

If operated by a human being at a remote location, elevator position and open/closed monitoring capability (likely already put in place when the elevator was installed) would be required for all elevators in service in the elevator bank, as would an on site device or devices similar in function to an ATM machine for taking cash and dispensing winnings. Television and/or audio devices for communication between the operator and the player could also be used, or betting, playing, and collecting instructions could be printed on or near the machine or read from a video screen in a position convenient to the player. All devices would be solidly constructed and securely mounted to prevent tampering or theft and all necessary recording functions could be performed either by the on site devices, by the remote operator, or by both, either all or in part.

If the game is operated by an automated gaming machine, the automated gaming machine would incorporate all of the features and capabilities of the ATM like device described above, plus other features necessary to allow the machine to function entirely without the need for a human operator. The machine will be solidly constructed and would be installed in a secure manner in a position convenient for the player. The machine would provide, either by signs on or near it or by a video or other display, instructions for betting, playing, and collecting winnings. The machine would accept bets in any amount the house allowed, accept payment for those bets in any manner the house allowed, and make payment to winning players in whichever of the manners allowed by the house that the player has in advance specified. If the players required betting receipts, those would be printed at the time the bet was placed, and the machine would provide, either locally or by connection or wireless transmission to a remote site, or both, all betting, play, and elevator records the house might require.

To enhance the number of players taking advantage of the betting opportunity offered by the game, the pressing of the call button to summon an elevator to the bank of elevators at which the game is being played could signal the game operator or game machine at that location to announce the opportunity to wager. This announcement may be made by any means the house deems appropriate, whether by visual or auditory cue, and should be made every time an elevator is summoned, even if an elevator has already been summoned to that location by another person. To encourage excitement with the gaming experience, similar auditory and/or visual cues could be used when a player wins and is rewarded with payment.

In accordance with a preferred embodiment of the invention, a method for playing a wagering game between a banker and a player includes:

(a) providing a site of play, the player disposed at the site of play;

(b) providing an elevator car which stops at the site of play;

(c) the player making a prediction about a future arrival of the elevator car at the site of play;

(d) the player placing a wager that the prediction of step (c) is correct; and, (e) the banker paying the player a payoff if the prediction of step (c) is correct.

In accordance with another aspect of the invention, a method for playing a wagering game between a banker and a player includes:

(a) providing a site of play, the player disposed at the site of play;

(b) providing a plurality of elevator cars each of which stops at the site of play;

(c) the player making a prediction about a future arrival of an elevator car at the site of play;

(d) the player placing a wager that the prediction of step (c) is correct; and, (e) the banker paying the player a payoff if the prediction of step (c) is correct.

In accordance with another aspect of the invention, an automated gaming machine for wagering upon the future arrival of an elevator car at a site of play includes:

means for a player to make a prediction about a future arrival of an elevator car;

means for a player to place a wager that the prediction is correct; and, means for a player to receive a payoff if the prediction is correct.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 5 is a flow chart illustrating a multiple elevator embodiment of the present invention;

DETAILED DESCRIPTION OF THE INVENTION

Figure 1:
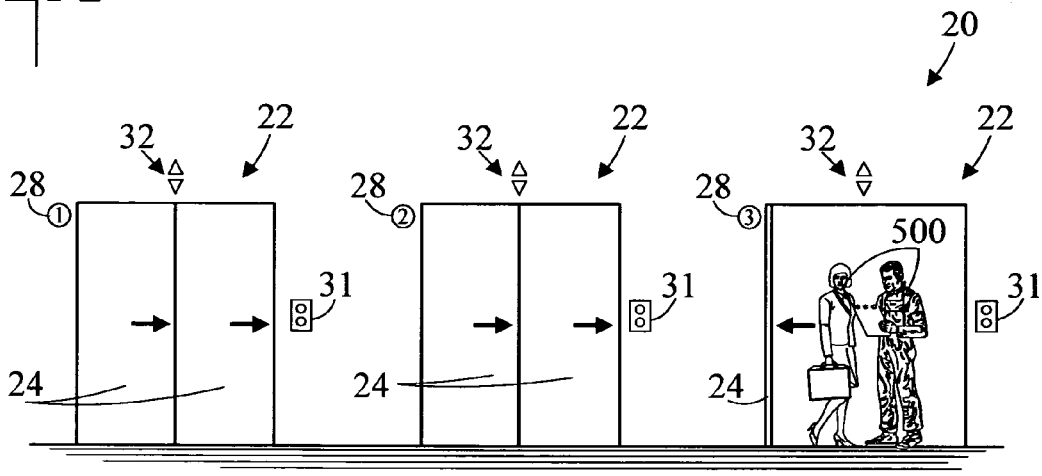
FIG. 1 is a front elevation view of a site of play.
Figure 2:
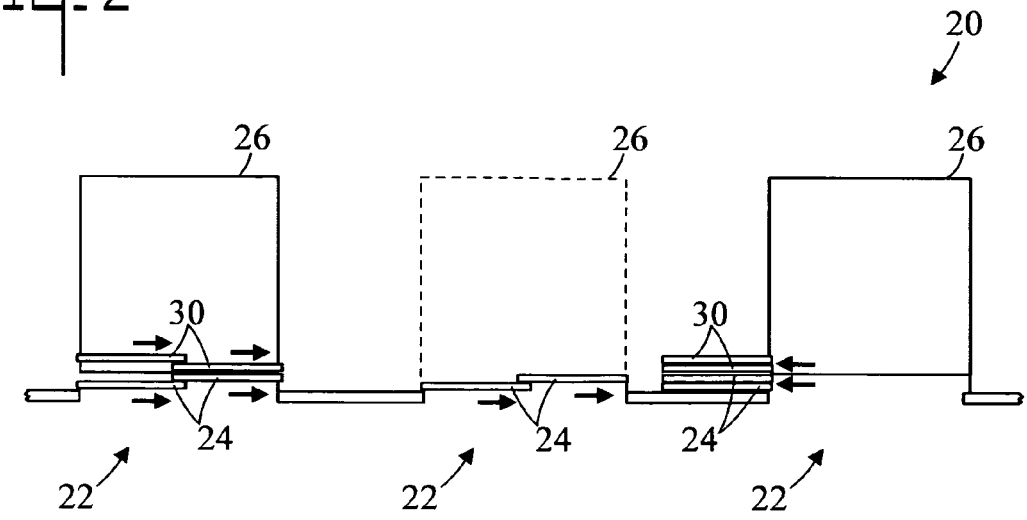
FIG. 2 is a top plan view of the site of play.

FIGS. 1 and 2 illustrate front elevation and top plan views, respectively, of a site of play 20. In the shown embodiment, site of play 20 is the elevator entrance and exit area (elevator foyer, building hallway, waiting area, etc.) on a floor of a multi-story building. A plurality of elevator stations 22 are disposed at site of play 20. It may be appreciated that the plurality can include two elevator stations 22, three elevator stations 22 (shown), four elevator stations 22, or any number greater than one elevator station 22. However, it may also be appreciated that a single elevator station 22 could be disposed at site of play 20. Each elevator station 22 includes (1) a door 24, and (2) a unique elevator station identifier 28. In the shown embodiment, door 24 includes two sliding outer door panels that are physically attached to elevator station 22. A corresponding plurality of elevator cars 26 are provided, wherein one elevator car 26 cooperates with (can stop at) each elevator station 22 at site of play 20. Also in the shown embodiment, elevator car 26 includes door 30 that includes two sliding inner door panels that are attached to elevator car 26. Both door 24 and door 30 must be open (as in elevator number 3 of FIGS. 1 and 2) in order for passengers 500 to enter and exit elevator car 26. It is common practice in the elevator industry to open and close doors 24 and 30 in unison. It is noted that in FIGS. 1 and 2 for elevator station number 1, elevator car 26 has stopped at door 24 but that both doors 24 and 30 are closed. For elevator station number 2, elevator car 26 is at another floor (indicated by dashed lines) and door 24 is closed. For elevator station number 3, elevator car 26 has stopped at door 24 and doors 24 and 30 are both open providing passenger access to elevator car 26 from site of play 20. It is noted that unique elevator station identifier 28 can be a physical marker such as a number (shown), letter, or the like placed adjacent elevator station 22. Alternatively, the elevator station identifier 28 could be implied such as "the middle elevator" or "the end elevator on the right", etc. Each elevator station 22 also includes up and down call buttons 31 that are used to bring elevator car 26 to site of play 20.

Each elevator station 22 has an arrival alert 32 that automatically broadcasts when its elevator car 26 arrives at site of play 20. In the shown embodiment, arrival alert 32 includes up and down lights that illuminate to indicate both the arrival of elevator car 26 at site of play 20 and the next direction of travel. Arrival alert 32 can also include an audio signal such as a bell, tone, buzzer or the like that sounds when elevator car 26 arrives at site of play 20. It is noted that arrival alert 32 can broadcast either slightly before, simultaneous with, or slightly after the opening of door 24. In an embodiment of the present invention, the arrival alert 32 for each elevator 22 is continuously monitored and recorded. That is, the state of elevator car 26 (including the opening of doors 24 and 30) is mechanically, electrically, or electronically sensed and recorded to prevent fraud in play or payoffs, and as necessary to accurately determine which elevator car 26 arrives next, first, etc. This feature could either record only the winning elevator, allowing the inactivity of the other elevators to be known by presumption, or it could record the actions and inactions of all elevators upon each opening.

In another embodiment of the invention, for each elevator station 22 a prevent closure mechanism 36 (refer to FIG. 6) such as an interlock is provided that prevents closure of doors 24 and 30 until wagers have been paid off (refer to step (e) below). Device 36 could be anything from a locally or remotely operated switch, to a wedge or other object placed in elevator door 24 by a banker game attendant to keep it from closing. In the case of automated gaming machines 34 (refer to FIG. 7 and the associated discussion), it would likely be an electronically (computer) controlled switch wired from automated gaming machine 34 to the elevator's control mechanism.

Elevator cars 26 can be programmed to operate in numerous ways. For example elevator car 26 can be programmed to start in one direction (up or down) and continue to move in that direction until it reaches the top or bottom floor and then reverse direction. Alternatively, elevator car 26 can be programmed to start in one direction, stop at all floors having an activated call button 31 in that direction, and then reverse and respond to all the call buttons in the opposite direction. Also elevator car 26 can be programmed to return to a baseline floor such as the lobby and open its doors if there are no call buttons 31 pressed on any floor. Other variations of elevator car 26 programming are also possible.

Figure 3:
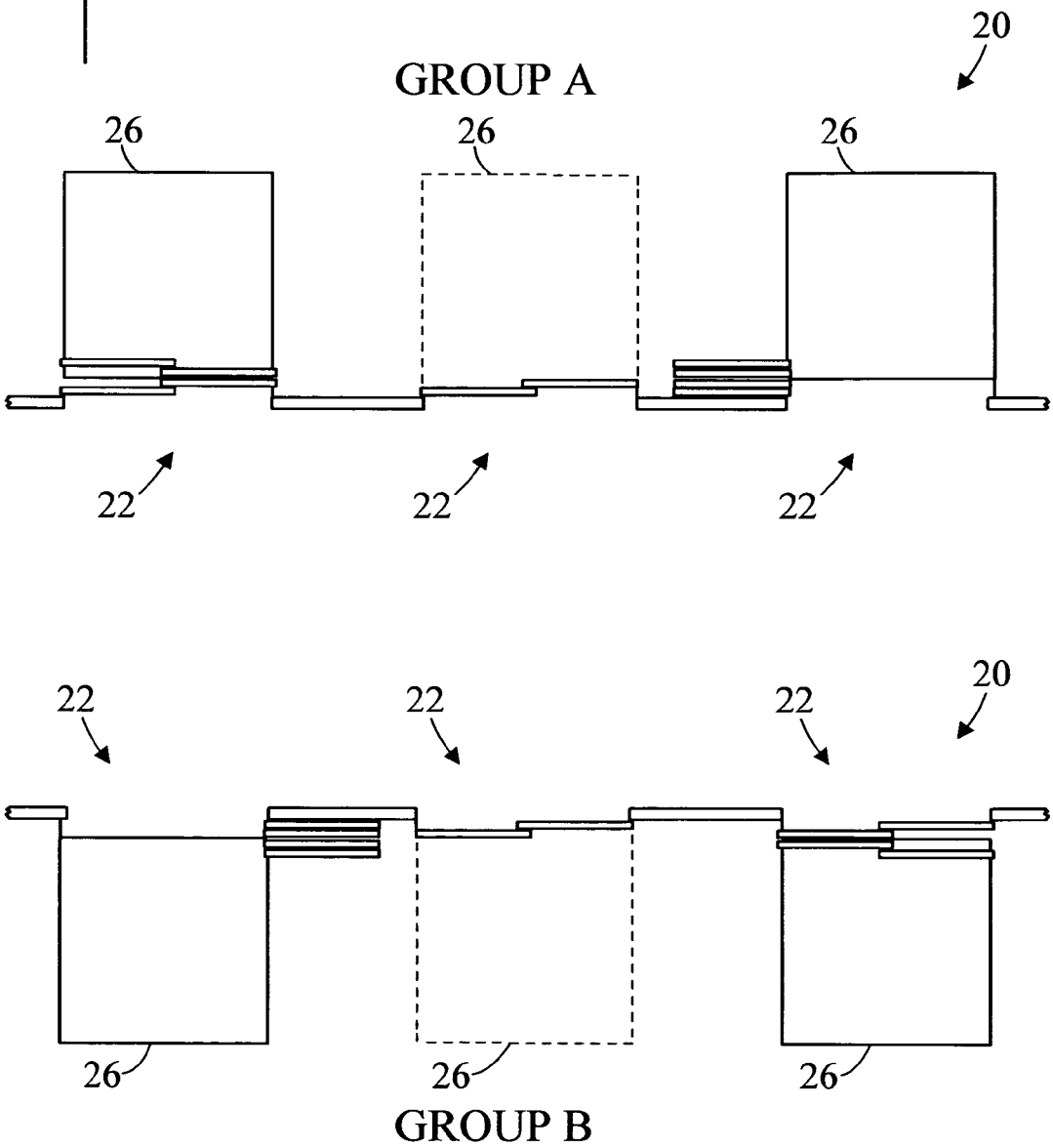
FIG. 3 is a top plan view of two groups of elevators.

FIG. 3 is a top plan view of two groups (i.e. banks) of elevator stations 22 at site of play 20. For example, the three elevator stations 22 comprising Group A could be a north bank of elevator stations 22, and the three elevator stations 22 comprising Group B could be a south bank of elevator stations 22.

Figure 4:
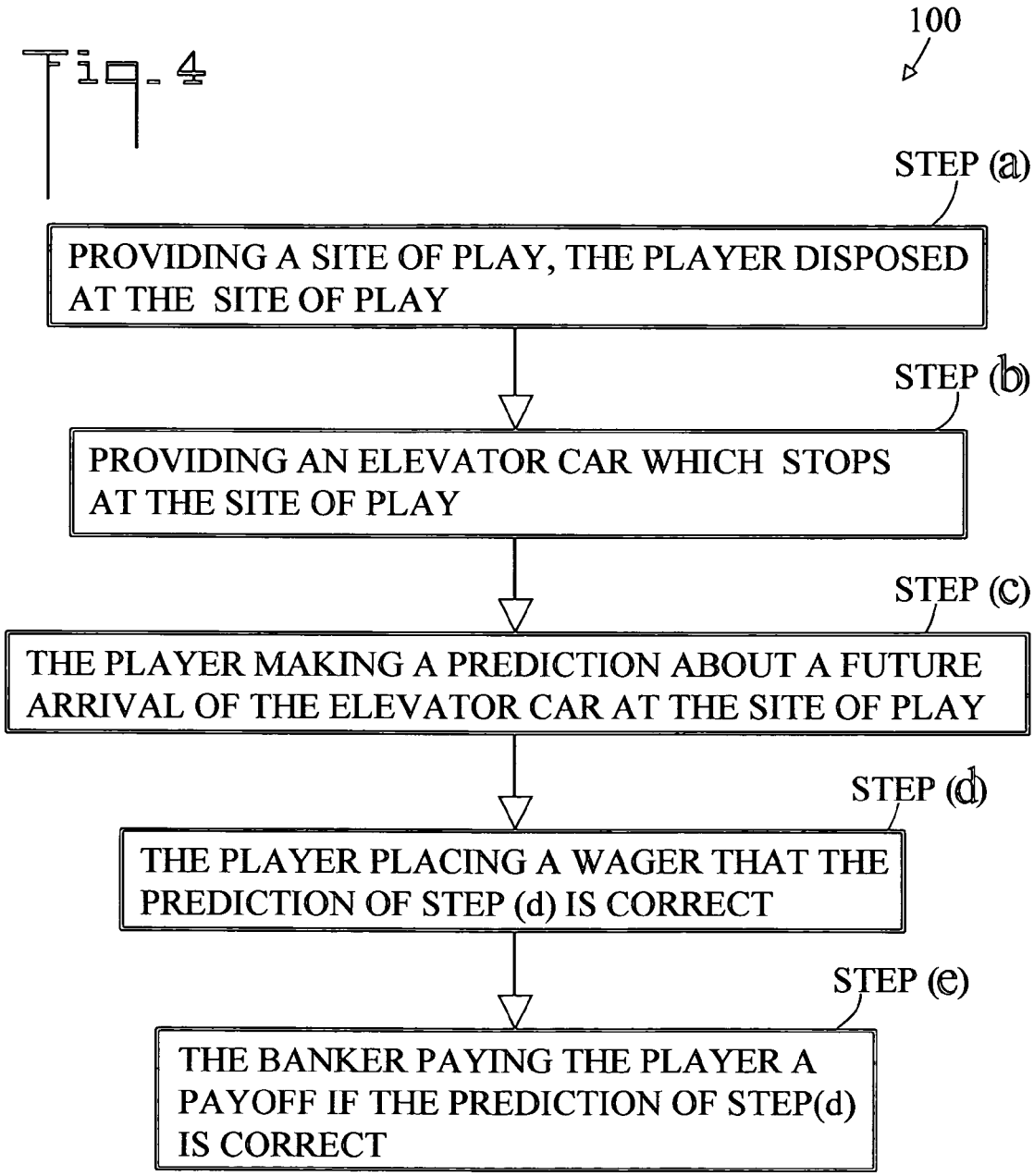
FIG. 4 is a flow chart illustrating a method for playing a wagering game between a banker and player based upon the arrival of an elevator in accordance with the present invention.

FIG. 4 is a flow chart illustrating a method for playing a wagering game between a banker and a player based upon the arrival of an elevator car 26 in accordance with the present invention, the method generally designated as 100. Method 100 can be used in buildings having one or more elevator cars 26 and associated elevator stations 22. Also referring to FIGS. 1-3, and 6, the banker represents the "house" which owns and operates the wagering game. The house can be the owner of the building in which the elevator station(s) 22 and elevator car(s) 26 are located, or alternatively the house could be a gaming entity that has acquired the right to operate the wagering game of the present invention in the building.

In step (a) a site of play 20 is provided, and a player 502 (refer to FIG. 6) is disposed at site of play 20. Site of play 20 is typically the elevator entrance and exit area (elevator foyer) on a floor of a multistory building. At least one automated gaming machine 34 is disposed at site of play 20 (refer to FIG. 6).

In step (b), an elevator car 26 which stops at site of play 20 is provided. Elevator car 26 stops at an associated elevator station 22 that is disposed at site of play 20. That is, in conventional fashion, elevator car 26 stops at elevator station 22 at site of play 20, and also stops at a similar elevator station 22 on each floor of the multi-story building that elevator car 26 serves. Elevator station 22 has an arrival alert 32 that broadcasts when elevator car 26 arrives at site of play 20. Elevator station 22 also has a door 24 that opens when elevator car 26 arrives, and a prevent closure mechanism 36 for preventing closure of door 24 until after the payoff of step (e) (refer to step (e) below and the associated discussion). In an embodiment of the invention, a device 37 (refer to FIG. 6) is provided which senses and records elevator car 26 actions. For example, device 37 could sense and record the time elevator car 26 arrives at elevator station 22, the time elevator door 30 opens or closes, whether elevator car 26 was traveling up or down when it arrived, etc.

In step (c) player 502 makes a prediction about a future arrival of elevator car 26 at site of play 20. That is, before it arrives, player 502 predicts one or more features that elevator car 26 will have when it does arrive at site of play 20. For example, the prediction might include whether after arrival elevator car 26 will next travel up or next travel down. Other predictions can include:

- whether elevator car 26 was previously traveling up or previously traveling down;
- whether elevator car 26 will (1) arrive within a given period of time, or (2) not arrive within a given period of time; or,
- other predictions about elevator car 26 when it arrives at site of play 20, such as discussed below.

In another embodiment of the invention, the prediction of step (c) can include a plurality of predictions, and a corresponding plurality of wagers (refer to step (d) below). For example, player 502 could predict that (1) elevator car 26 will arrive within 30 seconds, and (2) that elevator car 26 will next be traveling up. Player 502 could then win on one, both, or neither of the two predictions. Also, player 502 could make a "combination" prediction and only one wager. For example player 502 could predict that elevator car 26 is traveling down when it arrives and that two passengers will get off at site of play 20, and place a single wager that both of these predictions are correct. Then both of the two predictions must be correct in order to win the wager.

In another embodiment of the invention, the prediction of step (c) can include predicting features pertaining to the passengers 500 of elevator car 26 when it arrives at site of play 20. For example: Will the next arriving elevator car 26 contain more men or more women? How many passengers will the next arriving elevator car 26 have? Will there be an odd or even number of passengers in the next arriving elevator car 26? How many passengers will exit elevator car 26? Will an odd or even number of passengers exit? What color are the shoes of the first exiting passenger? The variations are virtually endless.

It may be appreciated that the prediction of step (c) can include a negative prediction (i.e. a prediction that something will not happen).

In another embodiment of the invention, in step (c) certain predictions are not permitted. For example, it would not be permitted to predict that the next elevator car 26 to arrive at the site of play will next travel up if the site of play is located on the lowest floor served by the elevator car 26. Or in a building having multiple elevators, it would not be permitted to predict that a particular elevator car 26 will not next arrive at site of play 20 if that elevator car 26 was the last elevator car to arrive at site of play 20.

In step (d) player 502 places a wager that the prediction of step (c) is correct. For example, in step (c) player 502 could predict that elevator car 26 will be traveling down when it arrives at site of play 20, and then in step (d) place a wager of $2 that the prediction of step (c) will occur and elevator car 26 will in fact be traveling down when it arrives at site of play 20. In betting practice, the prediction of step (c) and the placing of the wager in step (d) occur nearly simultaneously as is done in other gambling games such as craps, roulette, etc.

In an embodiment of the invention, (1) a wagering cycle begins when a first wager is placed (by any player 502) after the broadcast of the arrival alert 32 of a previous wagering cycle, and (2) a wagering cycle ends when a next arrival alert 32 is broadcast.

In another embodiment of the invention, the wager of step (d) is limited to a maximum amount. This feature guards against fraud wherein a group of people could try and influence the game by purposefully pressing the call button, causing the arrival of an elevator car 26 to be delayed, keeping the elevator car door 30 closed, and the like. If the wager is for a relatively small amount, such devious activities would not be profitable.

Figure 7:
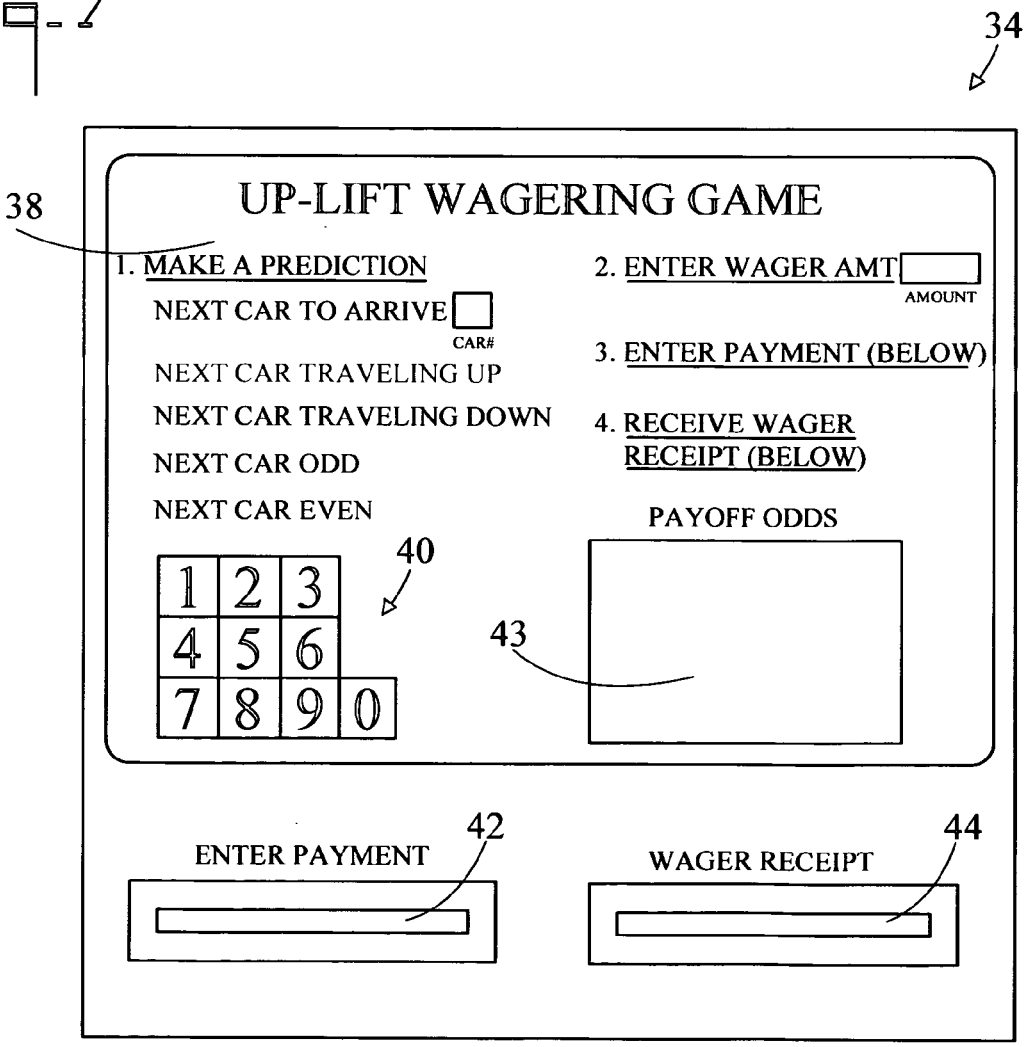
FIG. 7 is a front elevation view of an automated gaming machine.
Figure 8:
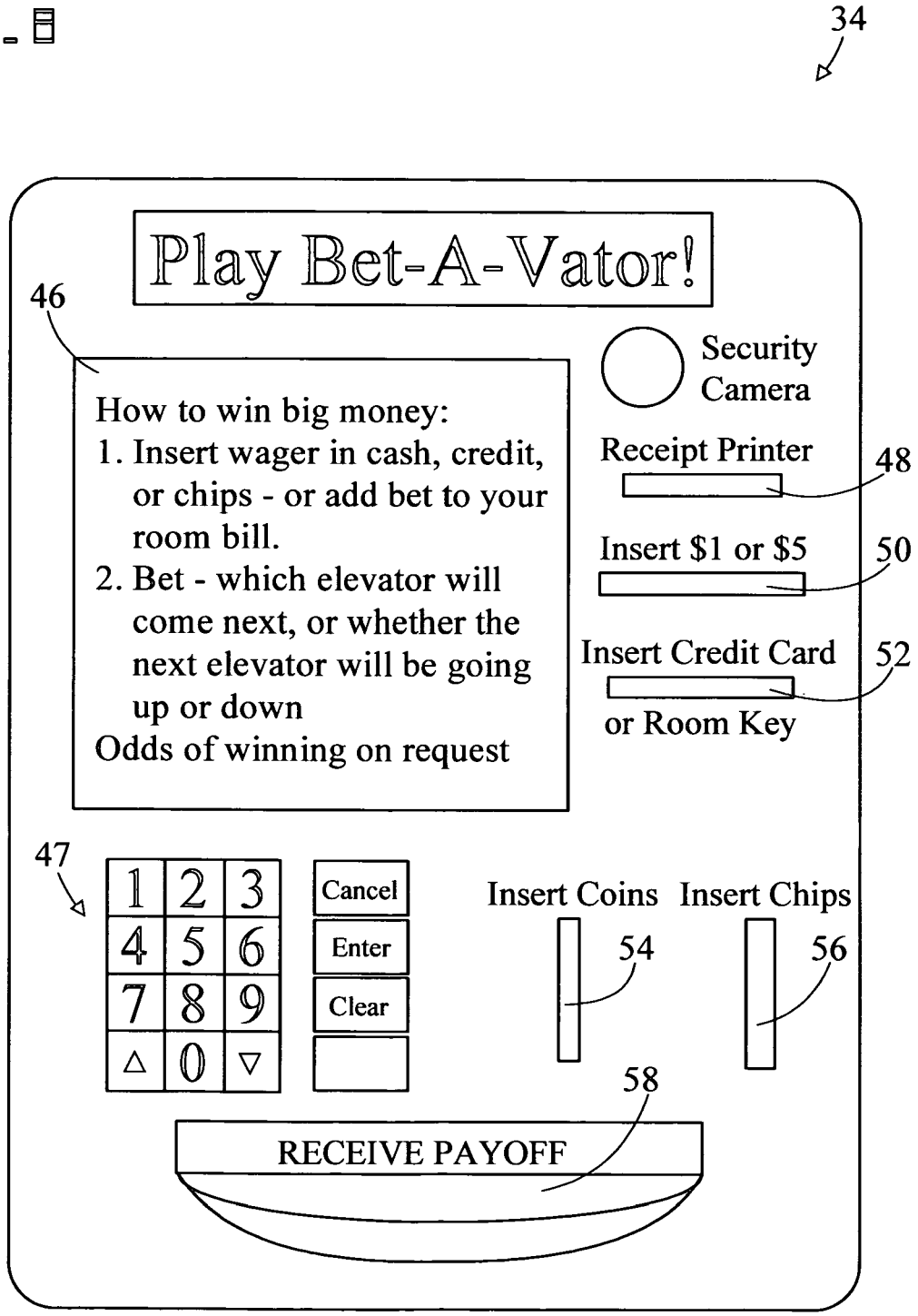
FIG. 8 is a front elevation view of another automated gaming machine.
Figure 9:
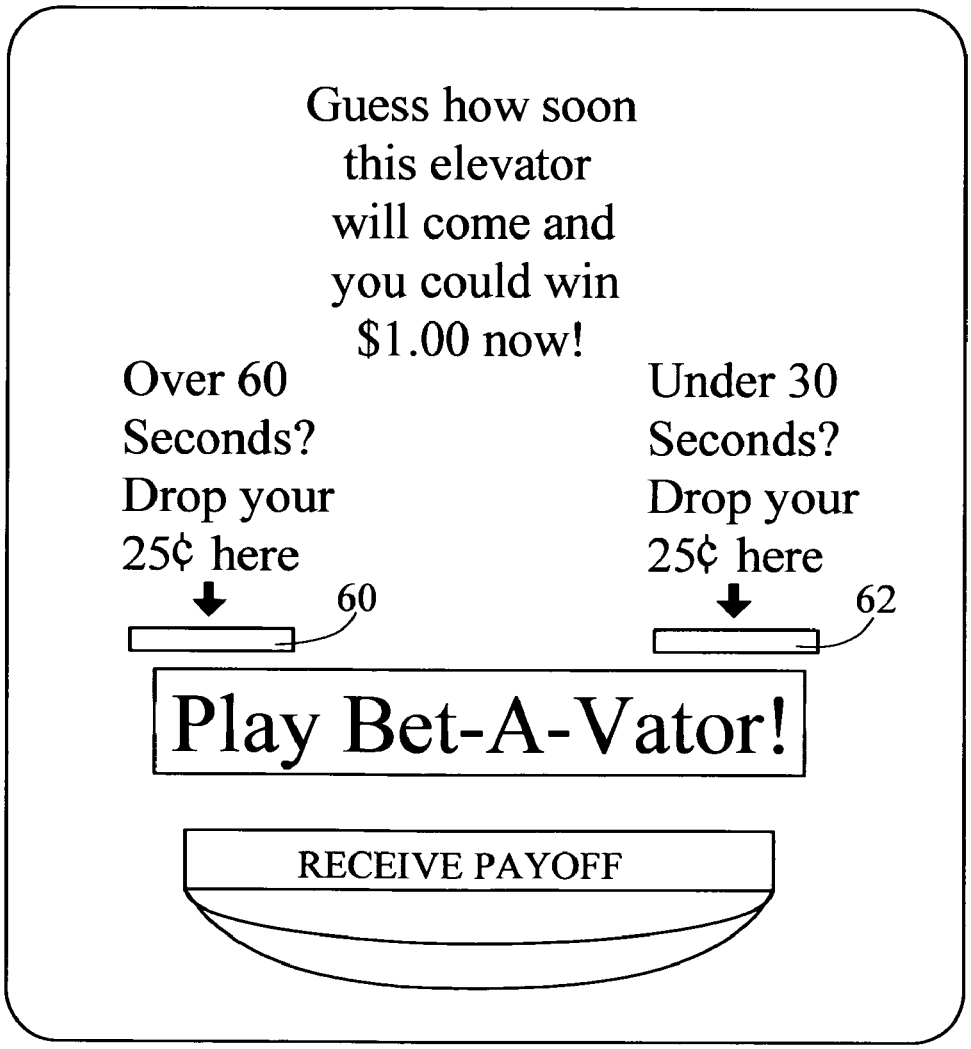
FIG. 9 is a front elevation view of another automated gaming machine, this one designed expressly for use in making wagers on a single elevator station; and, FIG. 10 is a top plan view of a gaming table.

In another embodiment of the invention, an automated gaming machine 34 is disposed at site of play 20 and is used by player 502 to make the prediction of step (c) and place the wager of step (d) (refer to FIGS. 7-9 and the associated discussions). In another embodiment of the invention, instead of money, a credit card, or a token (a gaming chip) being inserted into automated gaming machine 34 to effect the player's bet, a magnetic or a punched card room key is inserted (to be billed to the player's room account) to place the wager of step (d) (refer to FIG. 8 and the associated discussion).

Figure 10:
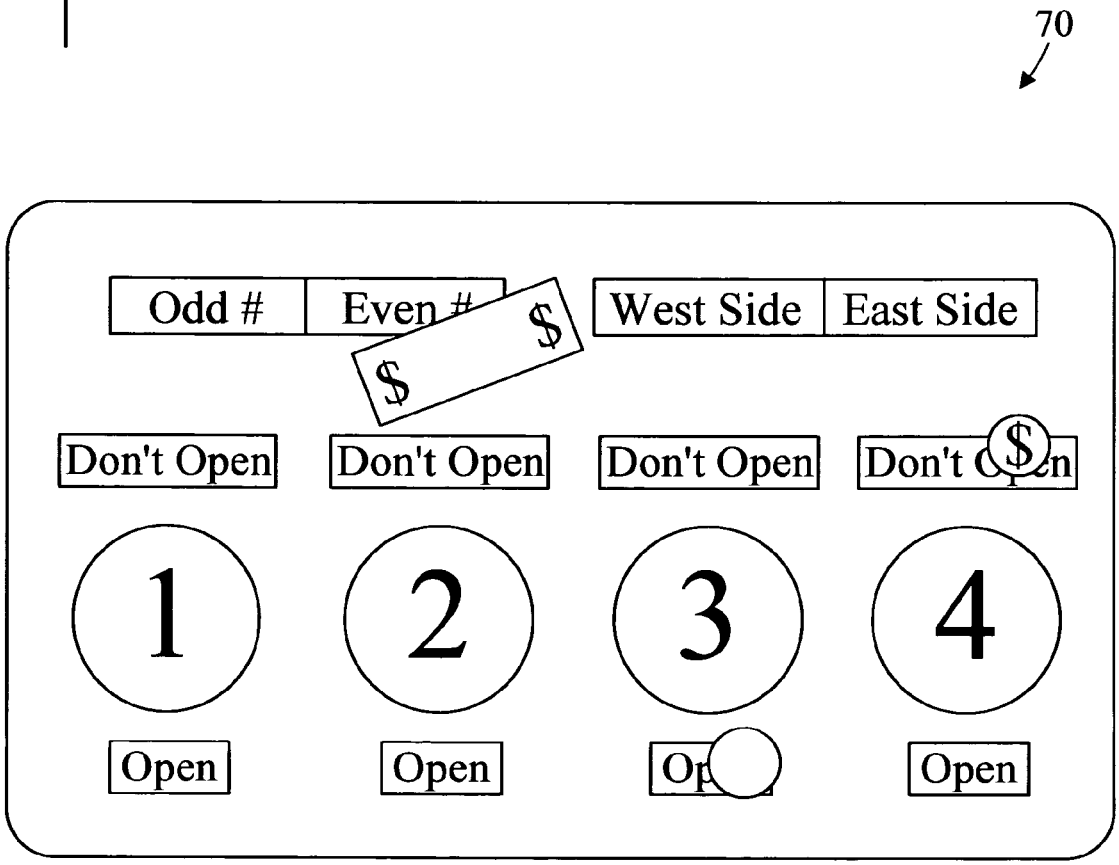

In another embodiment of the invention, a gaming table 70 is disposed at site of play 20 (refer to FIG. 10). Gaming table 70 is used by player 502 to make the prediction of step (c) and place the wager of step (d) (refer to FIG. 10 and the associated discussion). The gaming table 70 is operated by a representative(s) of the banker.

In another embodiment, method 100 is controlled by a representative(s) of the banker who is disposed at a location remote from site of play 20.

In step (e), the banker pays player 502 a payoff if the prediction of step (d) is correct. It may be appreciated that before a payoff is made in step (e), the banker must observe the arrival of the elevator car(s) 26 and determine if the prediction of step (d) is correct. The amount of the payoff depends upon specific wagering odds established by the house. These wagering odds can be developed using mathematical and/or empirical calculations, and will factor in a house advantage. That is, the payoff odds will be less than the true odds so that the house has an advantage and will win money in the long run. For example, in a multiple elevator building if ten elevator cars 26 stop at a site of play 20, the payoff for picking the correct next elevator car 26 to arrive could be seven times the wager rather than the mathematically correct nine times the wager.

As used herein. "the banker paying the player a payoff" can mean (1) that the banker or a banker assistant (a person) physically pays the payoff such as in the gaming table embodiment of FIG. 10, or (2) that an automated gaming machine or the like (refer to FIGS. 7-9) automatically pays the payoff for the banker.

Additionally, the payoff can vary as a function of the time of day, the location of the site of play 20, etc. For example, on a wager of how many passengers are in the next elevator car 26, it is more likely that an elevator car 26 which arrives at the ground floor of a business building will contain more people just after the close of a business day than it does at 10:00 a.m.

FIG. 5 illustrates a multiple elevator embodiment of the present invention. If a building has multiple elevators, more predicting and wagering options are available than with a building having a single elevator. In this embodiment, in step (b) a plurality of elevator cars 26 each of which stops at site of play 20 are provided. In new step (f), a corresponding plurality of elevator stations 22 are disposed at site of play 20, wherein each elevator station 22 cooperates with an elevator car 26 and has a unique elevator station identifier 28. In step (c), the player makes a prediction about a future arrival of an elevator car 26 of the plurality of elevator cars at site of play 20. For example, the prediction might include picking which elevator car 26 will next arrive at site of play 20. As such, the prediction would include picking the elevator station 22 by elevator station identifier 28 which would have the next arriving elevator car 26. In an embodiment of the invention, the next arriving elevator car 26 would be determined by which elevator station door 24 opens first. Other predictions of step (c) can include:

- picking an elevator car 26 which will not arrive next at site of play 20;
- whether a next elevator car 26 to arrive at site of play 20 will arrive at an elevator station 22 which has an odd elevator station identifier 28 or has an even elevator station identifier 28;
- whether a next elevator car 26 to arrive at site of play 20 will be (1) in a group of elevator stations 22, or (2) not in a group of elevator stations 22;
- other predictions about the next elevator car 26 to arrive at site of play 20;
- predictions about a second, third, etc. elevator car 26 to arrive at site of play 20; or,
- other predictions as applicable from the general embodiment of FIG. 4 (next travel up or next travel down, previously traveling up or previously traveling down, arrive within a given period of time, not arrive within a given period of time, a plurality of predictions, prediction of passenger features, etc.)

In another embodiment of the invention, in step (c) player 502 makes a prediction about a first elevator car 26 to arrive at site of play 20 at or after a specified time of day. For example, the house might establish every five minutes as specified times of day. So a player 502 could predict the first elevator car 26 to arrive at or after 11:00 a.m., or the first elevator car 26 to arrive at or after 3:35 p.m., or the first elevator car 26 to arrive at or after 9:55 p.m., etc. If the player predicts that a specific elevator car will be the first to arrive at or after 2:10 p.m., all elevators cars arriving at the site of play 20 before 2:10 p.m. are not considered. Only the first elevator car 26 to arrive at or after 2:10 p.m. is counted. If the first elevator car to arrive at site of play 20 at or after 2:10 p.m. is the elevator car 26 predicted by player 502 in step (c), then player 502 will win the wager he or she places in step (d). Put another way, this embodiment is synchronous based upon elevator car 26 arriving at or after a specific time of day, as opposed to the first embodiment which is asynchronous based upon the next elevator car 26 to arrive at site of play 20. Step (c) predictions in this embodiment can include:

- picking a first elevator car 26 to arrive at site of play 20 at or after a specified time of day;
- picking an elevator car 26 which will not arrive first at site of play 20 at or after a specified time of day;
- whether a first elevator car 26 to arrive at site of play 20 at or after a specified time of day will next travel up or down;
- whether a first elevator car 26 to arrive at site of play 20 on or after a specified time of day was previously traveling up or down;
- whether a first elevator car 26 to arrive at site of play 20 at or after a specified time of day will arrive at an elevator station 22 which has an odd or even elevator station identifier 28 or has an even elevator station identifier 28;
- whether a first elevator car 26 to arrive at site of play 20 at or after a specified time of day will be (1) in a group of elevator stations, or (2) not in a group of elevator stations;
- whether a first elevator car 26 to arrive at site of play 20 at or after a specified time of day will (1) arrive within a given period of time, or (2) not arrive within a given period of time; or,
- features pertaining to the passengers of the first elevator car 26 to arrive at site of play 20 at or after a specified time of day.

Figure 6:
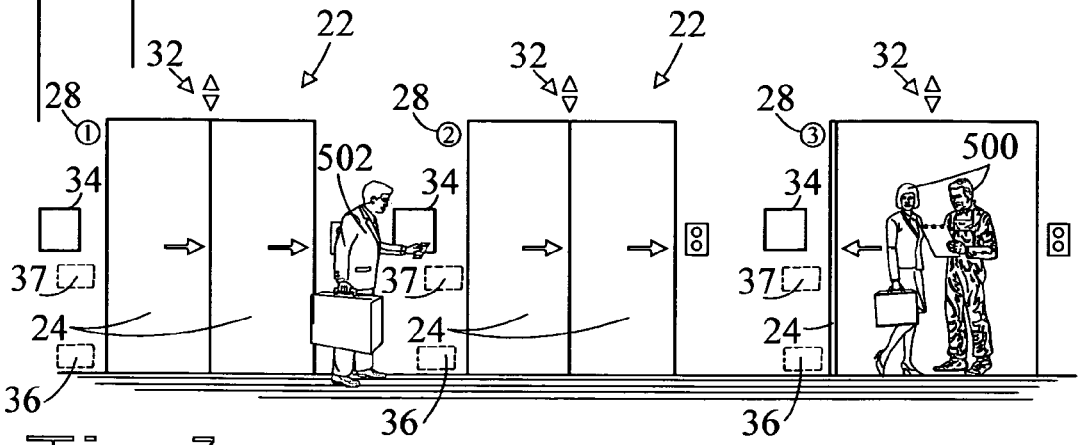
FIG. 6 is a front elevation view of the site of play including a player.

FIG. 6 is a front elevation view of site of play 20 including a player 502. Player 502 is using automated gaming machine 34 to place a wager. In the shown embodiment, one gaming machine 34 is provided for each elevator station 22 of a multiple elevator station 22 site of play 20. Prevent closure mechanism 36 (shown in dashed lines) prevents closure of doors 24 and 30 (refer to FIG. 2) until wagers have been paid off. Device 37 (shown in dashed lines) senses and records elevator car 26 actions, and could also record associated elevator station 22 status.

FIG. 7 is a front elevation view of one possible embodiment of self-serve automated gaming machine 34. Automated gaming machine 34 permits wagering upon the future arrival of an elevator car 26 at site of play 20. Automated gaming machine 34 provides (1) means for making a prediction about a future arrival of an elevator car, (2) means for making a wager that the prediction is correct, and (3) means for receiving a payoff if the prediction is correct. In the shown embodiment, automated gaming machine 34 has a touch screen display 38 which permits player 502 to make a prediction and enter a wager amount. Player 502 can predict (1) the next elevator car 26 to arrive at site of play 20 (using a keypad 40 to enter the number of the selected elevator station 22), (2) if the next elevator car 26 to arrive will be travelling up when it arrives, (3) if the next elevator car 26 to arrive will be travelling down when it arrives, (4) if the next elevator car 26 will arrive at an odd elevator station 22, or (5) if the next elevator car 26 will arrive at an even elevator station 22. The payoff odds for various predictions and combinations of predictions are displayed in a display area 43. Combination wagers are also possible, for example that elevator car 26 will arrive first and that it will be travelling down. Player 502 then enters a wager amount using keypad 40. Player 502 then pays for the wager by entering a credit card, room key, money, or the like in a payment slot 42. The player 502 may then receive a wager receipt from dispenser 44, such wager receipt being redeemable at a facility of the banker in the event that payment for a winning bet is not made otherwise.

In general terms, the means for making a prediction about a future arrival of an elevator car 26 can include pressing or touching a button, touching a computer touch screen, using a keypad, and the like. The means for placing a wager that the prediction is correct can include, inserting currency or coins, inserting gaming chips (if located in a building that has gaming), inserting a credit, debit, or "cash" card, inserting a magnetic or punched card room key (to be billed to a current guest account), entering a personal identification number, entering a password, entering bio-metric information, and the like. The means for the player to receive a payoff if the prediction is correct can include (1) the automated gaming machine 34 dispensing currency, coins, or gaming chips, (2) the automated gaming machine 34 dispensing a redeemable (at a house facility) wagering receipt, or (3) the automated gaming machine electronically transferring a credit to a room bill or to a bank account, or the like. In an embodiment of the invention, automated gaming machine 34 will record all gaming transactions, and could be in electronic communication with a central game control system.

FIG. 8 is a front elevation view of another automated gaming machine 34. In this embodiment, automated gaming machine 34 has a display screen 46, a keypad 47, a receipt printer 48, a slot 50 for inserting $1 or $5 bills, a slot 52 for inserting a credit card or a room key, a slot 54 for inserting coins, and a slot 56 for inserting gaming chips. Automated gaming machine 34 also includes a payoff tray 58 in which (coin or chip) winnings are deposited.

FIG. 9 is a front elevation view of another automated gaming machine 34. In this embodiment, automated gaming machine 34 is placed at an elevator station 22, and has a coin slot 60 for wagering that the elevator car 26 will arrive in over 60 seconds, and another coin slot 62 for wagering that the elevator car 26 will arrive in under 30 seconds. The 30 second interval (or any such other interval) between the two comprises the wagering advantage of the house.

Automatic gaming machine 34 may be mounted in the wall (refer to FIG. 6), may be built into kiosk devices, or may be arranged in other ways. Additionally, one gaming machine 34 may be provided for each elevator station 22 (refer to FIG. 6), or alternatively one gaming machine could serve a plurality of elevator stations 22. Alternatively, a single gaming machine 34 could be used for each elevator bank to provide betting play for all elevators in service in the bank. Or one machine for each elevator could be used. Or two machines could be used for each bank with one machine providing betting play for the elevators on one side of the hall and the other for the elevators on the other side of the hall.

Automated gaming machines 34 is solidly constructed and may include built-in proximity, motion, and/or other sensors to enable it to announce its presence and the opportunity to play the game when a potential player enters the site of play. It also may inform the potential player about the full capability of the machine by playing or presenting recorded information, by showing information on its display screen, or both, and inviting the prospective player to play the game. And if requested, it will also quickly teach the potential player the rules, possible bets and combinations, and the payout odds set by the house. The arrival and direction detection and recording features and the door closure interlock feature (to ensure time for the payment of winners) that are external or human operator functions in the other embodiments are built into the automated gaming machine. They operate entirely independently of human control, but subject to human security override. All payouts may be made by the machine except payouts on room key bets, which may, at the house's option, either be paid by the machine in cash or chips or may be fed to the house computer for crediting to the player's room bill and may be evidenced by printed "win slips". Room key losses will be fed directly to the house computer to be marked on the player's account.

FIG. 10 is a top plan view of a gaming table 70 that is operated by a representative of the banker. Gaming table 70 is disposed at site of play 20 and is used by player 502 to make the prediction of step (c) and place the wager of step (d) (refer to FIGS. 4 and 5). Gaming table 70 is similar in concept to a craps table where players can place wagers on a specific area of the table. It is operated by a house employee who accepts wagers and makes payoffs. In the shown embodiment, player 502 can make a prediction and place a wager (in coin, currency, or a gaming chip) on the predicted outcome. The player 502 can predict and wager (1) that the door of a particular elevator car 26 (1 through 4 in the shown embodiment) will (1) open first, (2) not open first, (3) will be an odd numbered door, (4) will be an even numbered door, (5) will be in the west bank of elevators, or (6) will be in the east bank of elevators. The player 502 could also make multiple wagers, or a combination wager such as elevator number 3 will open first and elevator 2 will not open first. In the shown embodiment, one player 502 has placed a currency wager that the next elevator car 26 to arrive will arrive at an elevator station 22 that has an even elevator station identifier 28. Another player 502 has placed a coin wager that the next elevator car 26 to arrive will not arrive at elevator station 4. A third player 502 has placed a gaming chip wager that the elevator car 26 of elevator station 22 will not arrive next.

The gaming table 70 embodiment of the present invention is operated by an on site banker with assistants, if required. The banker's duties include:

- explaining the play of the game to new players and providing playing instructions;
- maintaining a bank;
- accepting wagers;
- observing the next elevator car 26 to arrive at the site of play;
- observing the state of the next elevator 26 (next going up or down, how many people on elevator, odd or even number, how many people exit, and any other parameters that might be the subject of a wager);

recording the results of each game cycle (next arriving elevator car 26, state of the elevator car 26, wagers made, payouts made); and, providing security monitoring (operator error, embezzlement, collusion, player fraud, etc.).

In all embodiments of the present invention one or more closed circuit video camera(s) can be used for game and payoff monitoring and security.

A potential player can be made aware of the opportunity to play the game in various ways, for example, by signage on or near an ATM-like money collector/dispenser with built-in display screen, video camera, microphone and speaker, by a live greeting and solicitation by the remote human game attendant who will see the prospective player on the built-in or another video camera and speak to him through the built-in speaker, by a recorded message keyed by the remote operator or by built-in proximity or motion detectors, by a printed handout, or by any other means or combination of means.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method for playing a wagering game between a banker and a player, comprising:

(a) providing an elevator entrance and exit area, the player disposed at said elevator entrance and exit area;

(b) providing an elevator car which stops at said elevator entrance and exit area;

(c) the player making a prediction about a future arrival of said elevator car at said elevator entrance and exit area;

(d) the player placing a wager that said prediction of step (c) is correct; and, (e) the banker paying the player a payoff if said prediction of step (c) is correct.

2. The method of claim 1, further including:

in step (c), said prediction including whether said elevator car will next travel up or next travel down.

3. The method of claim 1, further including:

in step (c), said prediction including whether said elevator car was previously traveling up or previously traveling down.

4. The method of claim 1, further including:

in step (c), said prediction including if said elevator car will (1) arrive within a given period of time, or (2) not arrive within a given period of time.

5. The method of claim 1, further including:

in step (c), said prediction including features pertaining to the passengers of said elevator car.

6. The method of claim 1, further including:

providing an elevator station disposed at said elevator entrance and exit area; and, said elevator station having an arrival alert which broadcasts when said elevator car arrives at said elevator entrance and exit area.

7. The method of claim 6, further including:

in step (d), a wagering cycle beginning when a first wager is placed after said broadcast of said arrival alert of a previous wagering cycle.

8. The method of claim 6, further including:

in step (d), a wagering cycle ending when a next arrival alert is broadcast.

9. The method of claim 6, further including:

said elevator station having a door; and said elevator station including a prevent closure mechanism for preventing closure of said door until after said payoff of step (e).

10. The method of claim 1, further including:

in step (a), an automated gaming machine disposed at said elevator entrance and exit area, said automated gaming machine used by the player to make said prediction of step (c) and place said wager of step (d).

11. The method of claim 1, further including:

in step (a), a gaming table disposed at said elevator entrance and exit area, said gaming table used by the player to make said prediction of step (c) and place said wager of step (d).

12. The method of claim 1, further including:

providing a device which senses and records elevator car actions.

13. The method of claim 1, further including:

in step (b), providing a plurality of elevator cars each of which stops at said elevator entrance and exit area;

(f) providing a corresponding plurality of elevator stations disposed at said elevator entrance and exit area, each said elevator station cooperating with a said elevator car, and each said elevator station having an elevator station identifier; and, in step (c), the player making a prediction about a future arrival of a said elevator car of said plurality of elevator cars at said elevator entrance and exit area.

14. The method of claim 13, further including:

in step (c), said prediction including picking a next elevator car to arrive at said elevator entrance and exit area.

15. The method of claim 13, further including:

in step (c), said prediction including picking an elevator car which will not arrive next at said elevator entrance and exit area.

16. The method of claim 13, further including:

in step (c), said prediction including whether a next elevator car to arrive at said elevator entrance and exit area will arrive at a said elevator station which has an odd elevator station identifier or has an even elevator station identifier.

17. The method of claim 13, said plurality of elevator stations including a group of elevator stations, the method further including:

in step (c), said prediction including whether a next elevator car to arrive at said elevator entrance and exit area will (1) be in said group of elevator stations, or (2) not be in said group of elevator stations.

18. The method of claim 13, further including:

in step (c), said prediction including picking a first elevator car to arrive at said elevator entrance and exit area at or after a specified time of day.

19. The method of claim 13, further including:

in step (c), said prediction including picking an elevator car which will not arrive first at said elevator entrance and exit area at or after a specified time of day.

20. The method of claim 13, further including:

in step (c), said prediction including whether a first elevator car to arrive at said elevator entrance and exit area at or after a specified time of day will next travel up or next travel down.

21. The method of claim 13, further including:

in step (c), said prediction including whether a first elevator car to arrive at said elevator entrance and exit area at or after a specified time of day was previously traveling up or previously traveling down.

22. The method of claim 13, further including:

in step (c), said prediction including whether a first elevator car to arrive at said elevator entrance and exit area at or after a specified time of day will arrive at a said elevator station which has an odd elevator station identifier or has and even elevator station identifier.

23. The method of claim 13, said plurality of elevator stations including a group of elevator stations, the method further including:

in step (c), said prediction including whether a first elevator car to arrive at said elevator entrance and exit area at or after a specified time of day will be (1) in said group of elevator stations, or (2) not in said group of elevator stations.

24. The method of claim 13, further including:

in step (c), said prediction including whether a first elevator car to arrive at said elevator entrance and exit area at or after a specified time of day will (1) arrive within a given period of time, or (2) not arrive within a given period of time.

25. The method of claim 13, further including:

in step (d), said prediction including features pertaining to the passengers of a first elevator car to arrive at said elevator entrance and exit area at or after a specified time of day.

26. A method for playing a wagering game between a banker and a player, comprising:

(a) providing an elevator entrance and exit area, the player disposed at said elevator entrance and exit area;

(b) providing a plurality of elevator cars each of which stops at said elevator entrance and exit area;

(c) the player making a prediction about a future arrival of a said elevator car at said elevator entrance and exit area;

(d) the player placing a wager that said prediction of step (c) is correct; and, (e) the banker paying the player a payoff if said prediction of step (c) is correct.

* * * * *